US006671960B2

(12) United States Patent
Kawafune et al.

(10) Patent No.: US 6,671,960 B2
(45) Date of Patent: Jan. 6, 2004

(54) ELECTRIC ROTARY SHAVER

(75) Inventors: Kyoichi Kawafune, Matsumoto (JP); Tsuyoshi Nakano, Matsumoto (JP); Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 29 days.

(21) Appl. No.: 10/147,106

(22) Filed: May 16, 2002

(65) Prior Publication Data

US 2002/0174546 A1 Nov. 28, 2002

(30) Foreign Application Priority Data

May 22, 2001 (JP) ..... 2001-152997

(51) Int. Cl.[7] ..... B26B 19/14
(52) U.S. Cl. ..... 30/43.6; 30/346.51
(58) Field of Search ..... 30/43.4, 43.5, 30/43.6, 346.51

(56) References Cited

U.S. PATENT DOCUMENTS 4,038,748 A * 8/1977 Tyler ..... 30/43.6
4,077,120 A * 3/1978 Herrick et al. ..... 30/43.5
4,087,909 A * 5/1978 Naemura ..... 30/43.4
4,137,629 A * 2/1979 Yamazaki ..... 30/43.5
4,896,421 A * 1/1990 Geertsma et al. ..... 30/43.6
6,199,282 B1 * 3/2001 Uchiyama et al. ..... 30/43.6
6,226,870 B1 * 5/2001 Barish ..... 30/43.6

* cited by examiner

*Primary Examiner*—Hwei-Siu Payer
(74) *Attorney, Agent, or Firm*—Koda & Androlia

(57) ABSTRACT

An electric rotary shaver including a cutter retaining plate equipped with cutter units each having an inner cutter and an outer cutter and detachably attached to an outer cutter frame of the shaver, and the shaver further including an attachment-detachment mechanism for mounting the cutter retaining plate to the outer cutter frame in a detachable fashion. The attachment-detachment mechanism includes a triangular boss and an engagement projection. The triangular boss is formed on the outer cutter frame and has engagement openings opened in its side surfaces, and the engagement projection is formed on a mounting knob held in cutter retaining plate. By turning the mounting knob with its engagement projection inserted in the boss and thus letting the engagement projection be engaged with the engagement opening, the cutter retaining plate is mounted to the outer cutter frame of the shaver in a detachable fashion.

5 Claims, 5 Drawing Sheets

ELECTRIC ROTARY SHAVER

BACKGROUND OF THE INVENTION

1. Field of the Invention

The present invention relates to an electric rotary shaver and more particularly to an electric rotary shaver in which a cutter retaining plate that supports the inner and outer cutters is detachably attached to an outer cutter frame.

2. Prior Art

Various types of electric rotary shavers have been proposed, and FIG. 6 shows an example of an electric rotary shaver that is equipped with three rotary cutters.

In this electric rotary shaver, a shaver head 20 is detachably mounted to the upper portion of a main body case 10 of the shaver. The shaver head 20 includes three cutter units 22 that are arranged so that the centers of the cutter units 22 are positioned at the vertices of an (imaginary) equilateral triangle. Each of the cutter units 22 comprises an outer cutter 24, an outer cutter case 26 and an inner cutter; and in the shown electric rotary shaver, the cutter units 22 are movable in an arbitrary direction with respect to the outer cutter frame 30 of the shaver head 20.

FIGS. 7 and 8 are explanatory diagrams that show the internal structures of the shaver heads in conventional electric rotary shavers. More specifically, FIGS. 7 and 8 show cutter retaining plates 32 that support the cutter units and are detachably attached to the outer cutter frames 30.

In the shaver shown in FIG. 7, the cutter retaining plate 32 that supports the cutter units 22 (each comprising the outer cutter 24, outer cutter case 26 and inner cutter 28) is screw-fastened to the outer cutter frame 30. More specifically, a mounting screw 34 is rotatably held in the cutter retaining plate 32, a female screw projection 36 into which the mounting screw 34 is screwed is formed in the inside surface of the outer cutter frame 30, and the cutter retaining plate 32 is attached to the outer cutter frame 30 by turning the mounting screw 34.

The outer cutter frame 30 is comprised of a side frame portion 30*a* and a top frame portion 30*b*. The top frame portion 30*b* is formed in a continuous fashion from the side frame portion 30*a* that engages the main body case 10 of the shaver, and three circular cutter unit holes that receive the cutter units 22 are formed in the top frame portion 30*b*. The female screw projection 36 is provided in the center 30*c* of the top frame portion 30*b*. The mounting screw 34 is also provided in the center of the cutter retaining plate 32 so as to positionally correspond to the female screw projection 36.

By screw-fastening the cutter retaining plate 32, in which the cutter units 22 have been mounted, to the outer cutter frame 30, the shaver head 20 having the projected cutter units 22 as seen from FIG. 6 is obtained. The shaver head 20 thus assembled is mounted to the upper portion of the main body case 10 of the shaver.

In the shaver shown in FIGS. 8A and 8*b*, a fastening plate 38 is rotatably attached to the cutter retaining plate 32, and a mounting projection 40 is formed vertically on the inside surface of the outer cutter frame 30. The fastening plate 38 is attached to the outer cutter frame 30 by way of engaging an engagement edge 40*a* formed at the tip end of the mounting projection 40 with the fastening plate 38.

As seen from FIG. 8B, the engagement edge 40*a* is shaped substantially in triangle when viewed from the end. In the fastening plate 38, an engagement opening 38*a* is formed so that the engagement edge 40*a* of the mounting projection 40 is inserted. The engagement opening 38*a* is also in a triangular shape so as to correspond to the shape of the engagement edge 40*a*.

When the cutter retaining plate 32 is to be attached to the outer cutter frame 30, the outer cutter frame 30 and cutter retaining plate 32 are positioned with the engagement edge 40*a* of the outer cutter frame 30 protruding from the engagement opening 38*a*. Then, the fastening plate 38 is turned, so that the engagement edge 40*a* and the fastening opening 38*a* are brought into a shifted positional relationship as shown in FIG. 8B, thus making an engagement. As a result, the cutter retaining plate 32 is attached to the outer frame 30.

When the cutter retaining plate 32 is to be detached from the outer cutter frame 30, the fastening plate 38 is rotated so that the engagement between the engagement edge 40*a* and the engagement opening 38*a* is released. Then, the cutter retaining plate 32 is pulled away from the outer cutter frame 30.

The reason that the cutter retaining plates 32 are detachably attached to the outer cutter frames 30 in electric rotary shavers is to allow removal of the cutter retaining plate 32 from the outer cutter frame 30 so that the inner cutters can be replaced. Accordingly, in the attachment-detachment mechanism which is used to attach and detach the cutter retaining plate 32 to and from the outer cutter frame 30, it is preferred that the attachment-detachment operation be done simply and the mechanism therefor be not complicated.

In this respect, the structure shown in FIG. 7 in which the cutter retaining plate 32 is screw-fastened to the outer cutter frame 30 with the mounting screw 34 has some problems. The operation to tighten and loose the mounting screw 34 by turning it must be performed each time the attachment-detachment is needed, and such an attachment-detachment cannot be done by a one-touch operation. Thus, the operation is bothersome.

On the other hand, in the structure that uses the fastening plate 38 as shown in FIGS. 8A and 8B, the attachment-detachment can be accomplished in a one-touch operation merely by rotating the fastening plate 38 by approximately one-half turn. Accordingly, the operation is simple. However, because the mounting projection 40 extends a considerable distance from the outer cutter frame 30, the strength and moldability of the mounting projection 40 becomes the problem.

SUMMARY OF THE INVENTION

The present invention solves the above-described problems with the prior art electric shavers.

It is, therefore, an object of the present invention to provide an electric rotary shaver in which the cutter retaining plate can be attached to and detached from the outer cutter frame by a one-touch operation, thus improving the operation of attaching and detaching the cutter retaining plate to and from the outer cutter frame.

It is another object of the present invention to provide an electric rotary shaver that involves a simple structure, uses internal space efficiently and has an improved operability.

The above objects are accomplished by a unique structure for an electric rotary shaver in which a cutter retaining plate equipped with cutter units each comprising an inner cutter and an outer cutter is detachably attached to an outer cutter frame; and in the present invention, the shaver further includes an attachment-detachment mechanism for attaching and detaching the cutter retaining plate to and from the outer cutter frame, and the attachment-detachment mechanism is comprised of:

a boss in the shape of a triangular tube having engagement openings formed in side surfaces thereof, and an engagement projection to be inserted in the boss so that when the engagement projection is in the boss and rotated relative to the boss, comer portions of the engagement projection are engaged and held in the engagement openings; and the boss is provided on the outer cutter frame and the engagement projection is provided on a mounting knob that is held in the cutter retaining plate.

In this structure, the boss can be provided on the mounting knob instead of on the outer cutter frame, and the engagement projection can be provided on the outer cutter frame instead of on the mounting knob.

In addition, when the boss or the engagement projection is provided in the outer cutter frame, the boss or the engagement projection is provided on a connecting section of the top frame portions of the outer cutter frame.

Furthermore, the mounting knob held in the cutter retaining plate is provided so that it is rotatably inserted in a through-hole formed in the cutter retaining plate.

In the electric rotary shaver of the present invention, the outer cutter frame is formed with three cutter unit holes for respectively receiving the cutter units therein so that the top frame portions extend from the connecting section in three branches; and the boss is provided on the connecting section so that the side surfaces of the boss are parallel to the cutter unit holes, and the engagement projection is provided at the tip end of the mounting knob. Instead, the engagement projection can be provided on the connecting section, and the boss is provided at the tip end of the mounting knob.

Furthermore, in the electric rotary shaver of the present invention, a spring that elastically presses against the engagement projection can be provided on the bottom of the boss, and a stopper that prevents the mounting knob from slipping out of the cutter retaining plate can be provided on the mounting knob.

DETAILED DESCRIPTION OF THE INVENTION

Figure 1:
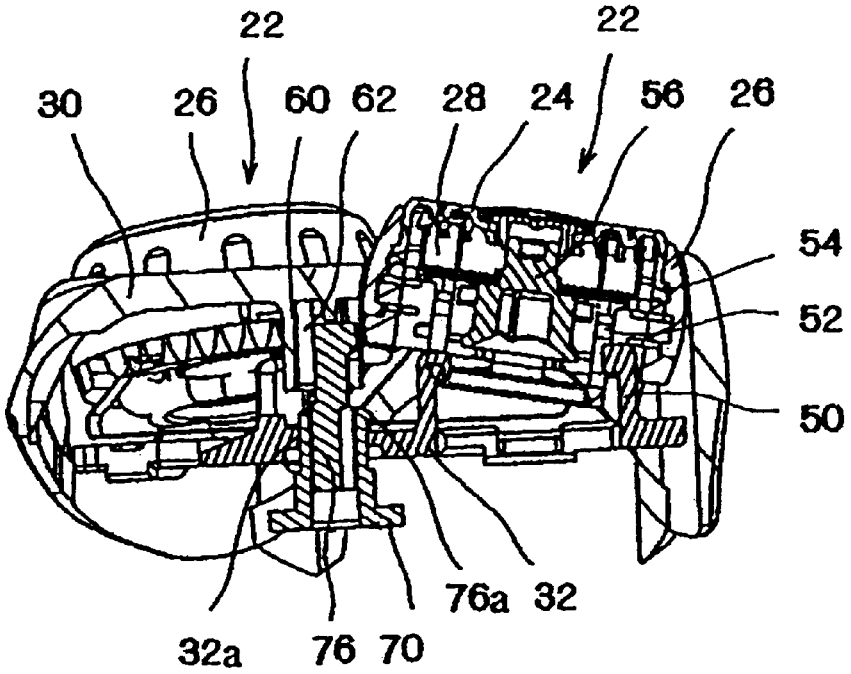
FIG. 1 is a sectional view of the shaver head of the electric rotary shaver according to the present invention.

The electric rotary shaver of the present invention is characterized in that the cutter retaining plate 32 is detachably attached to the outer cutter frame 30 via a novel structure. FIG. 1 shows the cutter retaining plate 32 attached to the outer cutter frame 30.

Figure 6:
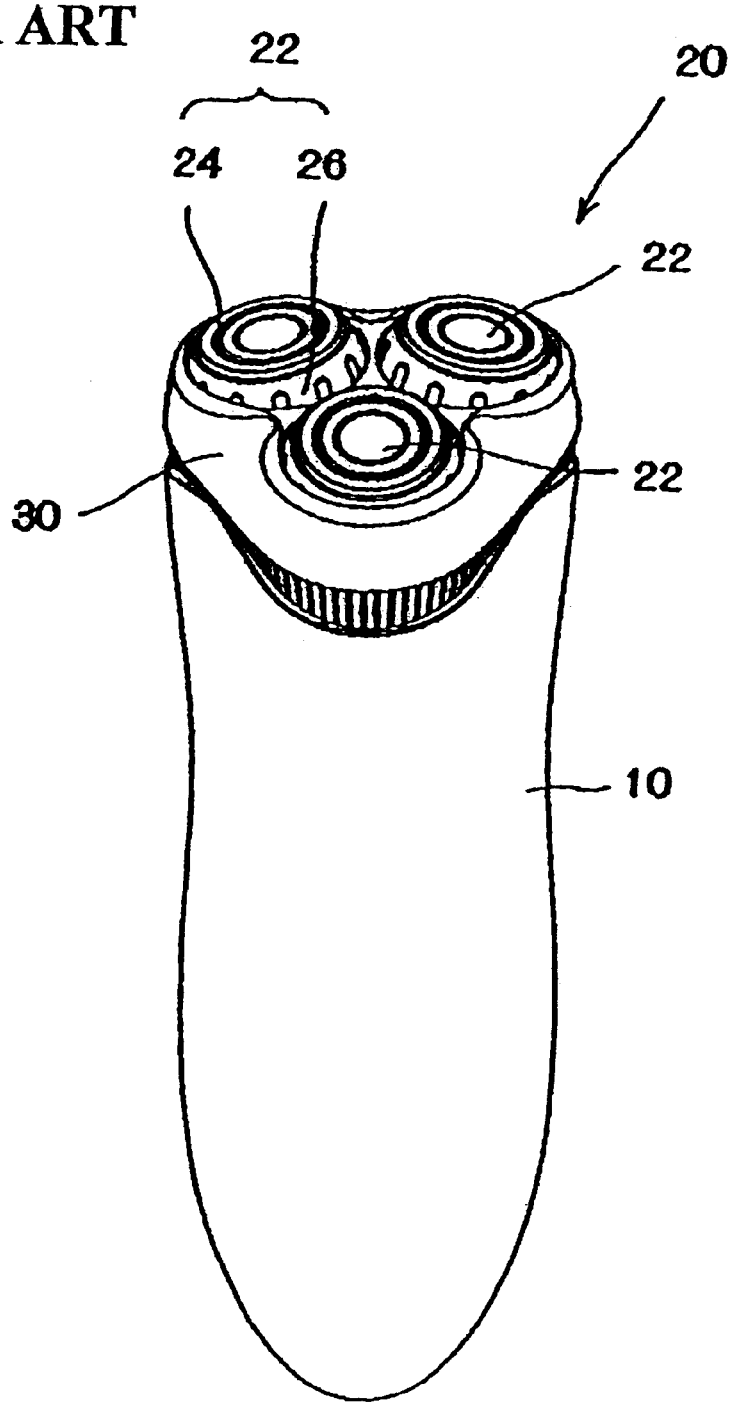
FIG. 6 PRIOR ART
FIG. 6 is an external view of an electric rotary shaver.
Figure 7:
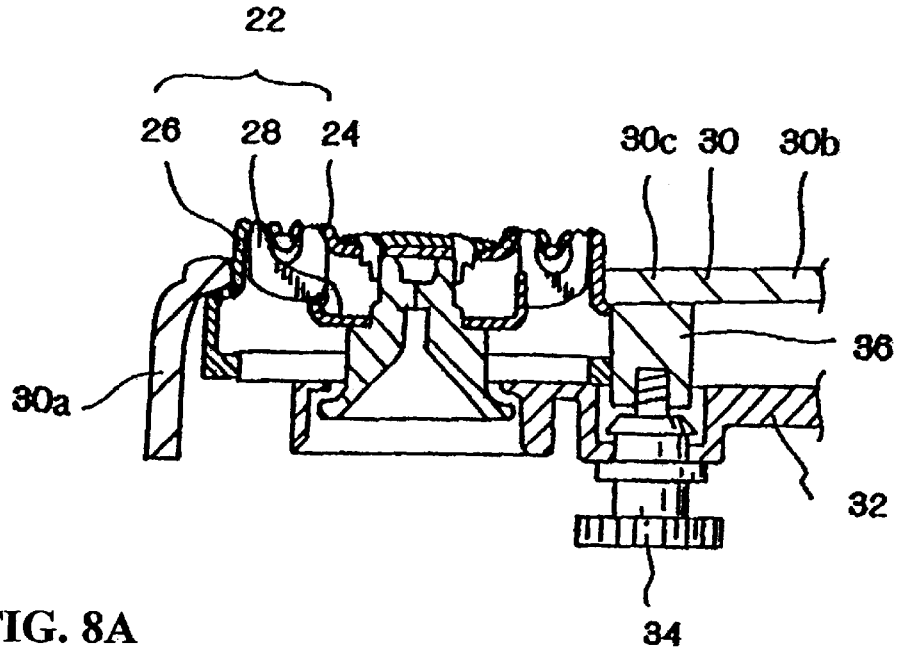
FIG. 7 PRIOR ART
FIG. 7 is an explanatory diagram of a conventional attachment-detachment mechanism for the outer cutter frame and cutter retaining plate.
Figure 8A:
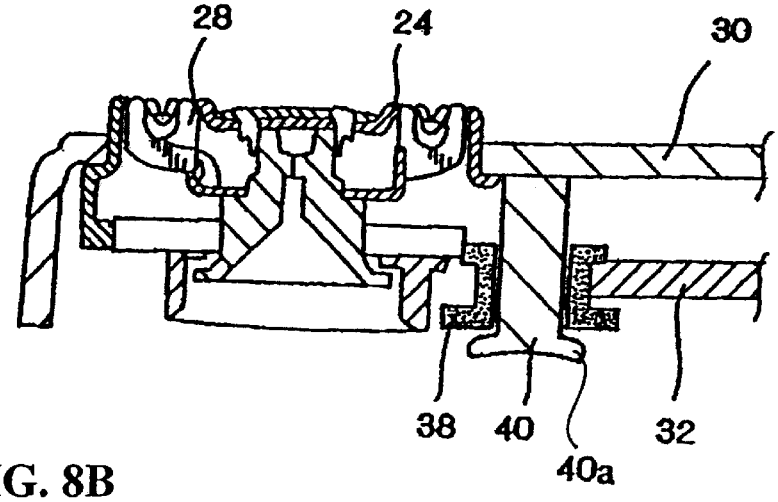
FIG. 8A PRIOR ART
FIGS. 8A and 8B show another conventional attachment-detachment mechanism for the outer cutter frame and cutter retaining plate.
Figure 8B:
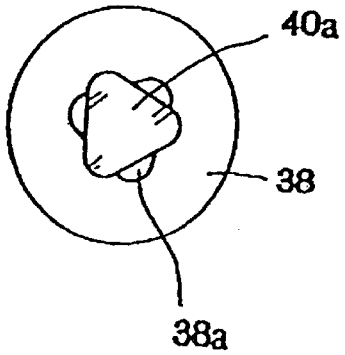
FIG. 8B PRIOR ART

Three cutter units 22 (only two of them shown) each comprising an inner cutter and an outer cutter as in the prior art shavers are supported by a known means (see application Ser. No. 09/759,476, for instance) in the cutter retaining plate 32, and a shaver head 20 is obtained by way of attaching the cutter retaining plate 32 to the outer cutter frame 30. As shown in FIG. 6, the shaver head 20 is mounted to the upper portion of a main body case 10 in a detachable fashion.

The cutter units 22 are provided so as to tilt in any desired direction. For this tiltable structure, supporting portions 50 are provided upright on the cutter retaining plate 32, and fulcrum plates 52 are tiltably supported on the supporting portions 50. Furthermore, outer cutter fastening rings 54 are provided so that the outer cutter fastening rings 54 can tilt on the fulcrum plates 52 in a direction perpendicular to the tilting direction of the fulcrum plates 52 with respect to the supporting portions 50. The fulcrum plates 52 are tiltably supported on the supporting portions 50 by pivot shafts provided on the supporting portions 50, and the outer cutter fastening rings 54 are tiltably supported by the pivot shafts provided on the fulcrum plates 52. As a result, the outer cutter fastening rings 54, i.e., the cutter units 22, can tilt in any desired direction.

The reference numeral 56 is an inner cutter bases (only one shown). The inner cutter drive shaft (not shown) installed in the main body case 10 engages with the inner cutter bases 56 when the shaver head 20 is mounted to the main body case 10. The inner cutter drive shaft is rotationally driven by a motor and causes, via the inner cutter bases 56, the inner cutters 28 to rotate underneath the outer cutters 24 (only one shown) so that shaving is performed.

The electric rotary shaver of the present invention is characterized by the fact that it includes a mechanism that attaches the cutter retaining plate 32 to the outer cutter frame 30 in a detachable fashion, and such a mechanism is substantially comprised of a boss 60 and a mounting knob 70.

The boss 60 is provided on the outer cutter frame 30, and the mounting knob 70 that engages with this boss 60 is provided on the cutter retaining plate 32. Instead, as will be described below, the boss 60 can be provided on the cutter retaining plate 32, and in this case, the mounting knob 70 that engages with the boss 60 is on the outer cutter frame 30.

Figure 2:
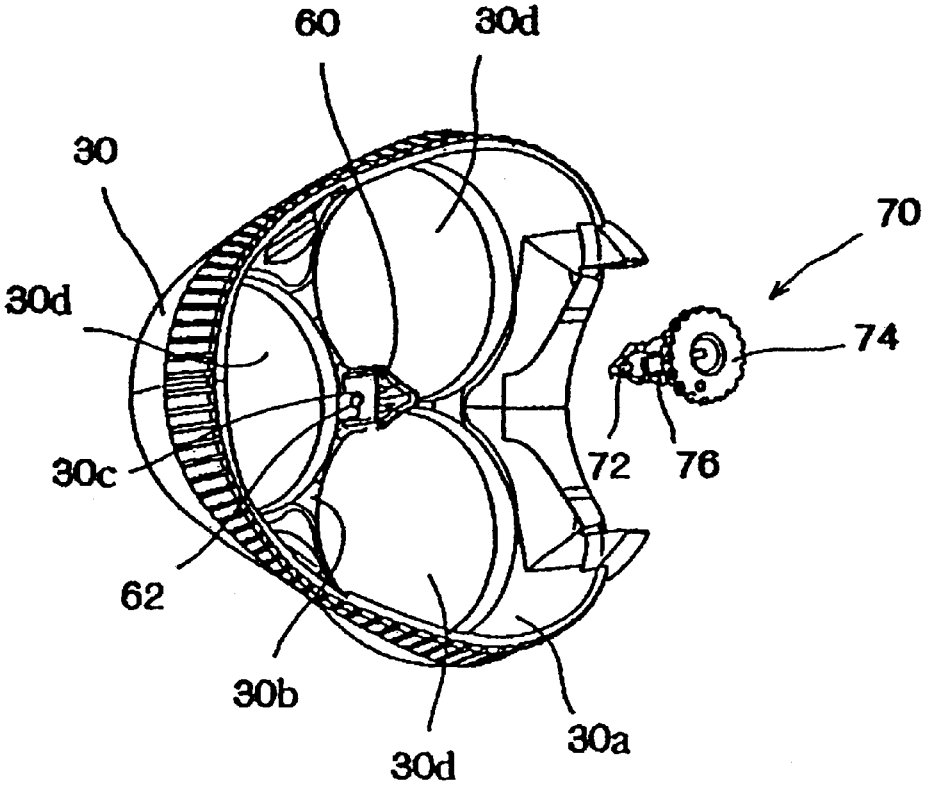
FIG. 2 is a perspective view of the outer cutter frame and the mounting knob.

FIG. 2 shows the outer cutter frame 30 and the mounting knob 70 in a perspective view in order to illustrate the structures of the boss 60 and mounting knob 70.

In the outer cutter frame 30, three circular cutter unit holes 30*d* into which the cutter units 22 are inserted and received are formed. The centers of the cutter unit holes 30*d* are located at the vertices of an (imaginary) equilateral triangle. The top frame portions 30*b* that constitute the boundary portions of the cutter unit holes 30*d* are connected at the center of the outer cutter frame 30 so as to form a connecting section 30*c*. The boss 60 is in the form of a triangular tube and is provided on the inner surface of the connecting section 30*c* so as to be vertical or upright with respect to the connecting section 30*c*. Engagement openings 62 are formed in each one of three side surfaces of the boss 60 so that the mounting knob 70 (more specifically, its engagement projection 72 (described later)) engages with such openings 62 of the boss 60.

Figure 3:
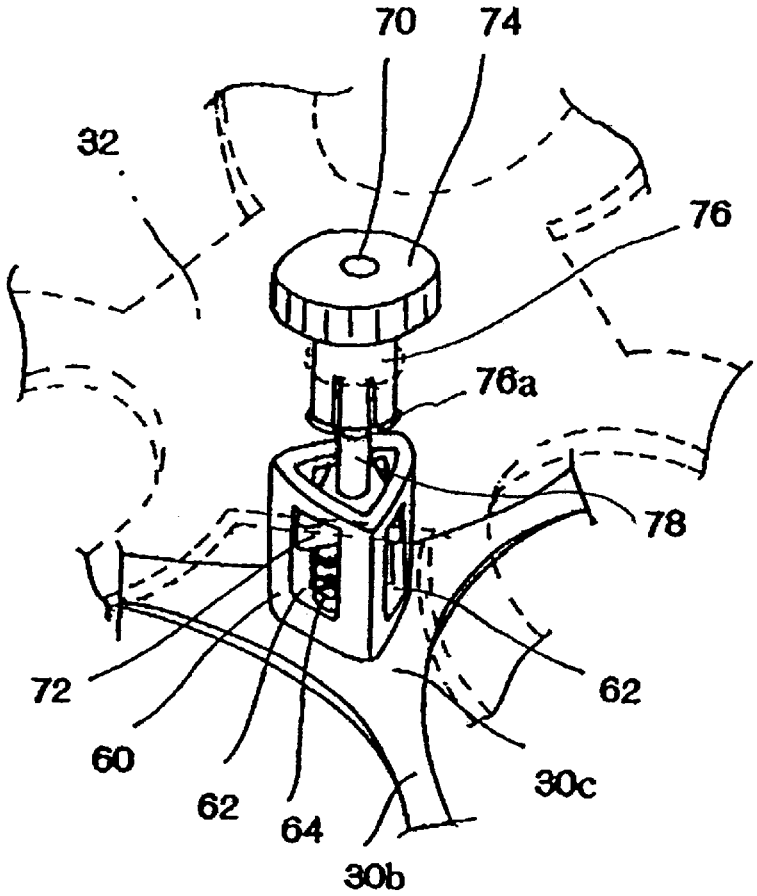
FIG. 3 is an explanatory diagram showing the mounting knob engaged with the boss.

The top frame portions 30*b* of the outer cutter frame 30 extend in three branches from the connecting section 30*c*, so that the connecting section 30*c* is, as seen from FIG. 3, somewhat a triangular shape when viewed in the axial direction of the outer cutter frame 30. The boss 60 is provided so that the three side surfaces thereof run along the side surfaces of the connecting section 30*c*, i.e., along the inner circumferences of the cutter unit holes 30*d*. As a result, the boss 60 is provided upright in the form of a triangular tube within a narrow area of the connecting section 30*c*.

In the shown embodiment, the respective side surfaces of the boss 60 are formed with a curved shape so that the side surfaces are curved slightly inward as seen from FIG. 2. In other words, the side surfaces of the boss 60 are formed so that the shape of the side surfaces conforms to the circular arc shape of the cutter unit holes 30*d*.

A spring (a coil spring) 64 is provided on the bottom surface of the boss 60. This spring 64 is installed so as to obtain a secure engagement of the mounting knob 70 (more specifically, the engagement projection 72) with the engagement opening 62 of the boss 60. A small projection (not shown) is formed at the bottom of the boss 60, and the spring 64 is fitted on this projection so that the spring 64 is secured inside the boss 60.

As seen from FIG. 2, the mounting knob 70 is provided with an engagement projection 72 at the tip end of its shank 78, and a head 74 is formed at the base end of the shank 78. The engagement projection 72 is shaped in triangle, and it is formed with dimensions that allow the engagement projection 72 to be inserted in the boss 60 when the side edges of the triangular engagement projection 72 are set parallel to the side surfaces of the triangular tubular boss 60 as seen from FIG. 4A.

A through-hole 32*a* through which the mounting knob 70 is passed is, as seen from FIG. 1, formed in the cutter retaining plate 32, and the mounting knob 70 is passed through this through-hole 32*a* so that the mounting knob 70 is rotatably held in the cutter retaining plate 32 and movable in its axial direction. In the shown embodiment, a sleeve 76 is provided so as to extend from the head 74 of the mounting knob 70, and this sleeve 76 is passed through the through-hole 32*a* of the cutter retaining plate 32.

A stopper 76*a* is formed at the tip end of the sleeve 76. The stopper 76*a* comes into contact with the inside surface of the cutter retaining plate 32, thus preventing the mounting knob 70 from slipping out of the cutter retaining plate 32. In order to facilitate the operation of the mounting knob 70, a spring (not shown) can be installed between the cutter retaining plate 32 and the mounting knob 70. With this spring installed, when the cutter retaining plate 32 is detached from the outer cutter frame 30, the mounting knob 70 can protrude from the cutter retaining plate 32. Since the mounting knob 70 is also prevented from slipping out of the cutter retaining plate 32 by the stopper 76*a* even when such a spring is provided, the mounting knob 70 can stay in the cutter retaining plate 32.

The outer cutter frame 30 can be formed into any desired shape by resin molding. In the outer cutter frame 30, the boss 60 is formed as an integral unit along with the side frame portion 30*a* and top frame portions 30*b*. The side surface portions of the boss 60 have a small thickness; and as a result of the flexibility of the resin itself, the side surface portions of the boss 60 are elastically deformable. Thus, the engaging operation of the mounting knob 70 with the boss 60 can be performed easily. The mounting knob 70 can also be easily formed into any desired shape by resin molding, so that the mounting knob 70 can be easily mounted in the cutter retaining plate 32.

Figure 4A:
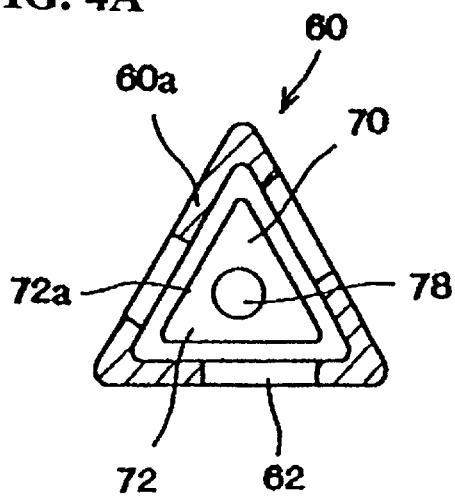
FIGS. 4A and 4B show the positional relationship between the boss and the engagement projection.
Figure 4B:
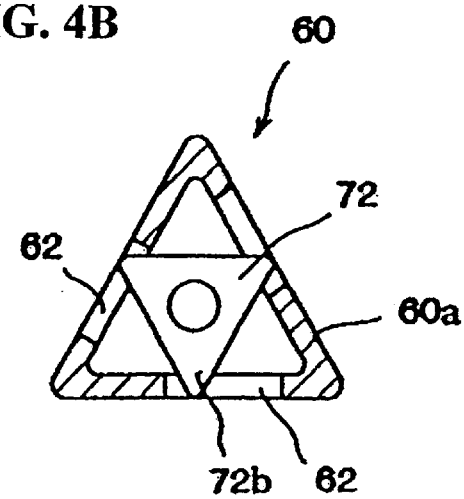

FIGS. 3, 4A and 4B illustrate the engagement between the mounting knob 70 and the boss 60 when the cutter retaining plate 32 is attached to the outer cutter frame 30.

FIG. 3 shows the mounting knob 70 engaged with the boss 60 so that the cutter retaining plate 32 is attached to the outer cutter frame 30.

More specifically, when the cutter retaining plate 32 is to be attached to the outer cutter frame 30, the mounting knob 70 in the cutter retaining plate 32 is held in place by a finger, and the cutter units 22 mounted in the cutter retaining plate 32 are aligned with the cutter unit holes 30*d* of the outer cutter frame 30. Then, the cutter retaining plate 32 is brought inside the outer cutter frame 30. When the alignment of the cutter units 22 with the cutter unit holes 30*d* is made as described above, the boss 60 on the outer cutter frame 30 and the mounting knob 70 on the cutter retaining plate 32 are positioned so as to face each other, and the engagement projection 72 of the mounting knob 70 contacts the boss 60 of the outer cutter frame 30.

The engagement projection 72 of the mounting knob 70 can be inserted in the boss 60 when the side edges 72*a* of the engagement projection 72 and the side surfaces 60*a* of the boss 60 are set substantially parallel as shown in FIG. 4A. Accordingly, when the engagement projection 72 comes into contact with the end surface of the boss 60 during the process of bringing the cutter retaining plate 32 into the outer cutter frame 30 with the head 74 of the mounting knob 70 being held by finger, the head 74 of the mounting knob 70 is turned slightly. With this turning, the interference between the engagement projection 72 and the boss 60 is eliminated, and the side edges 72*a* of the engagement projection 72 are set parallel to the side surfaces 60*a* of the boss 60. Thus, when the mounting knob 70 is pushed toward the boss 60, the engagement projection 72 of the mounting knob 70 is inserted in the boss 60 of the outer cutter frame 30, and the engagement projection 72 is brought in the boss 60 against the driving force of the spring 64.

After the engagement projection 72 is brought into the boss 60, when the mounting knob 70 is turned about the shank 78 thereof, a state in which the mounting knob 70 and the boss 60 are engaged as shown in FIG. 4B is obtained. In other words, the engagement projection 72 of the mounting knob 70 is rotated with respect to the boss 60, and the corner portions 72*b* of the engagement projection 72 enter and engage the engagement openings 62 formed in the side surfaces of the boss 60.

After this engagement, when the finger is released from the mounting knob 70, the engagement projection 72 is pushed back in its axial direction to a position where the engagement projection 72 contacts the edges of the engagement openings 62 by the spring 64 that is in contact with the end surface of the engagement projection 72. As a result, the mounting knob 70 and the boss 60 are securely engaged with each other, and the mounting knob 70 is held in this engaged position as shown in FIG. 3. As seen from FIG. 3, the spring 64 pushes the end surface of the engagement projection 72 toward the cuter retaining plate 32, the engagement projection 72 is held in a securely engaged state with the engagement openings 62, and the cutter retaining plate 32 is prevented from slipping out by the stopper 76*a* of the mounting knob 70, so that the cutter retaining plate 32 is mounted to the outer cutter frame 30.

As shown in FIGS. 4A and 4B, the engagement of the mounting knob 70 and boss 60 is obtained by the engagement of the engagement projection 72 of the mounting knob 70 and the engagement openings 62 of the boss 60. In this engagement process, the mounting knob 70 is turned from the state (disengaged position) shown in FIG. 4A in which the engagement projection 72 is in the boss 60 to the state (engaged position) shown in FIG. 4B in which the engagement projection 72 are engaged with the engagement openings 62. This turning of the mounting knob 70 is possible since the corner portions 72*b* of the engagement projection 72, upon turning of the mounting knob 70, push the side surfaces of the boss 60 sideways or to the outside, thus deforming the side surfaces. As described above, the boss 60 is molded from resins and thus possesses elasticity. Accordingly, the mounting knob 70 can be easily shifted (turned) from the disengaged position to the engaged position and from the engaged position to the disengaged position. Since the boss 60 and the engagement projection 72 are respectively formed in a triangular shape, the disengaged position and the engaged position are alternately switched by turning the mounting knob 70 approximately one-half turn.

In the actual operation, the mounting knob 70 is turned in a clicking manner as a result of the elastic action of the boss 60 when the corner portions 72*b* of the engagement projection 72 engages and disengages the engagement openings of the boss 60. Accordingly, the engaged position can be easily ascertained when the mounting knob 70 is turned.

In the shown embodiment, the attachment-detachment mechanism is obtained by forming the boss 60 and engagement projection 72 with triangular shapes as seen From FIG. 4A and by engaging these elements with each other. An engagement using such triangular shapes is more effective than using, for example, square shapes. With the triangular shape engagement, the engagement between the boss 60 and the engagement projection 72 of the knob 70 can be more stably maintained.

In the shown embodiment, the side surfaces of the boss 60 are slightly curved inwardly, and the engagement is obtained in even more stable manner by using such a curved shape. In the actual designing, the shapes and dimensions of the boss 60 and engagement projection 72 may be set with considerations given to the operating characteristics in turning the mounting knob 70 and the stability of the engaged state of the engagement projection 72 and boss 60.

Figure 5:
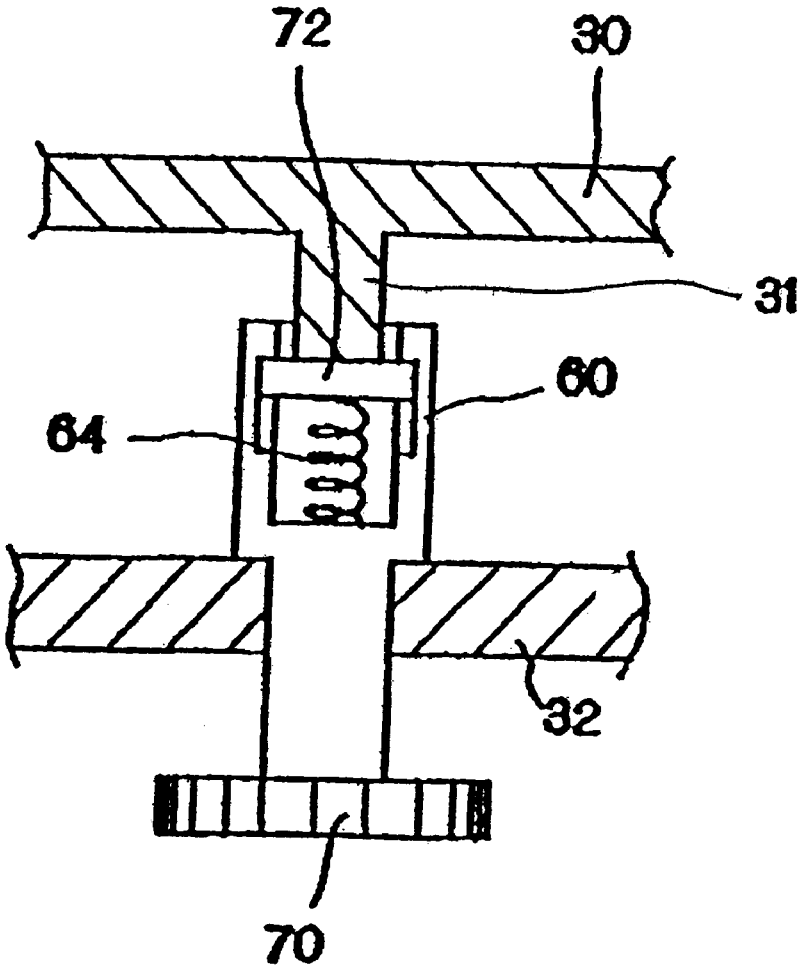
FIG. 5 is another explanatory diagram showing the mounting knob engaged with the boss.

Furthermore, in the above-described embodiment, the boss 60 formed with the engagement openings 62 is provided on the outer cutter frame 30, and the mounting knob 70 having the engagement projection 72 that engages with the boss 60 is provided on the cutter retaining plate 32. However, the engagement between the engagement openings 62 of the boss 60 and the engagement projection 72 of the mounting knob 70 is a relative engagement. Accordingly, it is of course possible to provide the engagement projection 72 on the outer cutter frame 30 and the boss 60 on the cutter retaining plate 32. FIG. 5 shows a structure in which the engagement projection 72 is provided on the outer cutter frame 30, and the boss 60 is provided on the cutter retaining plate 32.

In the structure of FIG. 5, a short supporting projection 31 is formed upright on the outer cutter frame 30, and the triangular engagement projection 72 is formed at the end of the supporting projection 31. The mounting knob 70 is provided in the cutter retaining plate 32, and the boss 60 of a triangular shape is provided at the tip end of the mounting knob 70. Engagement openings 62 with which the engagement projection 72 engages are formed in the side surfaces of the boss 60, and a spring 64 is provided inside the boss 60.

In this structure, switching between the engaged position in which the corner portions of the engagement projection 72 are engaged with the engagement openings 62 of the boss 60 and the disengaged position in which the engagement of the engagement projection 72 and boss 60 is released can be accomplished by turning the mounting knob 70. In other words, by way of pressing the mounting knob 70 toward the outer cutter frame 30, turning the mounting knob 70 by a finger, and then releasing the finger from the mounting knob 50 with the engagement projection 72 being engaged with the engagement openings 62, the mounting knob 70 is caused to protrude (downward from the cutter retaining plate 32 as shown in FIG. 5) by the elastic force of the spring 64 to a position where the engagement projection 72 and the engagement openings 62 of the boss 60 are engaged. As a result, the engaged state of the engagement projection 72 on the outer cutter frame 30 with the boss 60 on the cutter retaining plate 32 is maintained.

As seen from the above, in the electric rotary shaver of the present embodiment, the engagement projection 72 and the (engagement openings 62 of the) triangular tubular boss 60 are engaged with each other, and these elements operate as an attachment-detachment mechanism of the cutter retaining plate 32 to and from the outer cutter frame 30. Accordingly, the engaged state of the engagement projection 72 and triangular tubular boss 60 is stably maintained, and a reliable attachment-detachment operation is performed.

Furthermore, switching between the engaged state and the disengaged state is accomplished by rotating either one of the boss 60 and the mounting knob 70 with the engagement projection 72 inserted in the boss 60. Accordingly, engaging and disengaging operations can be accomplished merely by turning the mounting knob 70 one-half turn. Thus, the attachment-detachment of the outer cutter frame 30 and the cutter retaining plate 32 is performed by a one-touch operation, thus providing an extremely good operability.

In the shown embodiments, the boss 60 or the engagement projection 72 is provided on the connecting section 30*c* at which the three top frame portions 30*b* of the outer cutter frame 30 are connected as a center of the outer cutter frame 30. Also, the boss 60 and the engagement projection 72 are formed in a triangular shape so as to conform to the shape of the connecting section 30*c*, which is also a triangular shape (see FIG. 3). Accordingly, the attachment-detachment mechanism can be formed in the connecting section 30*c* even in a case where the cutter unit holes 30*d* are provided closely to each other and the connecting section 30*c* is small. As a result, the cutter unit holes 30*d* can be provided without getting any interference from the disposition of attachment-detachment mechanism. Furthermore, since a structure in which the boss 60 and the engagement projection 72 are engaged is employed, the lengths of the boss 60 and engagement projection 72 can be shortened.

As seen from the above, in the electric rotary shaver according to the present invention, the cutter retaining plate having therein cutter units can easily be mounted to the outer cutter frame of the shaver, and the shaver has an improved operability. Also, since the structure of the attachment-detachment mechanism is simple, the electric shaver can be easily manufactured at a reduced manufacturing cost. Moreover, the installation space for the boss and engagement projection can be small, and the attachment-detachment mechanism can be easily obtained even when the cutter unit holes are formed in close proximity to each other in the outer cutter frame.

What is claimed is:

1. An electric rotary shaver comprising a cutter retaining plate that is equipped with cutter units each including an inner cutter and an outer cutter and detachably attached to an outer cutter frame, said shaver further comprising an attachment-detachment mechanism for attaching and detaching said cutter retaining plate to and from said outer cutter frame, wherein said attachment-detachment mechanism is comprised of:

a boss in a shape of a triangular tube having engagement openings formed in side surfaces thereof, and an engagement projection to be inserted in said boss so that when said engagement projection is in said boss and rotated relative to said boss, corner portions of said engagement projection are brought into an engagement with said engagement openings and held in said boss; and wherein said boss is formed on one of said outer cutter frame and a mounting knob that is rotatably provided in said cutter retaining plate, and said engagement projection is formed on the other of said outer cutter frame and said mounting knob.

2. The electric rotary shaver according to claim 1, wherein said outer cutter frame is provided with three cutter unit holes for respectively receiving each one of said cutter units, thus forming a connecting section from which top frame portions extend in three branches, and said boss is formed on said connecting section with said side surfaces of said boss shaped along inner circumferences of said cutter unit holes, and said engagement projection is formed at a tip end of said mounting knob.

3. The electric rotary shaver according to claim 2, wherein a spring that elastically presses against said engagement projection is provided in a bottom of said boss, and a stopper that prevents said mounting knob from slipping out of said cutter retaining plate is provided on said mounting knob.

4. The electric rotary shaver according to claim 1, wherein a spring that elastically presses against said engagement projection is provided in a bottom of said boss, and a stopper that prevents said mounting knob from slipping out of said cutter retaining plate is provided on said mounting knob.

5. The electric rotary shaver according to claim 1, wherein said outer cutter frame is provided with three cutter unit holes for respectively receiving each one of said cutter units, thus forming a connecting portion from which top frame portions extend in three branches, and said engagement projection is formed on said connecting section, and said boss with which said engagement projection is engaged is formed at a tip end of said mounting knob.

* * * * *